United States Patent [19]

Schwappach

[11] 4,192,089

[45] Mar. 11, 1980

[54] RETAINER FOR RELEASABLY SECURING A TOOTH TIP OF A DIGGER TOOTH

[75] Inventor: Dieter Schwappach, Dortmund, Fed. Rep. of Germany

[73] Assignee: O & K Orenstein & Koppel Aktiengesellschaft, Berlin, Fed. Rep. of Germany

[21] Appl. No.: 890,241

[22] Filed: Mar. 27, 1978

[30] Foreign Application Priority Data

Mar. 25, 1977 [DE] Fed. Rep. of Germany ..... 2713227

[51] Int. Cl.[2] ..... E02F 9/28

[52] U.S. Cl. ..... 37/142 A; 85/8.3; 403/379

[58] Field of Search ..... 37/142 A; 85/8.3, 8.8; 403/379; 299/92

[56] References Cited

U.S. PATENT DOCUMENTS

| | | | |
|---|---|---|---|
| 2,798,403 | 7/1957 | Launder | 37/142 A X |
| 3,511,126 | 5/1970 | Watts | 37/142 A X |
| 3,520,224 | 7/1970 | Hemsley et al. | 37/142 A X |
| 3,685,178 | 8/1972 | Ratkowski | 37/142 A |
| 3,894,349 | 7/1975 | Moreau | 37/142 A |

*Primary Examiner*—Clifford D. Crowder
*Attorney, Agent, or Firm*—Martin A. Farber

[57] ABSTRACT

A retainer for the releaseable securing of a tooth tip of a digger tooth on a holder, the tooth tip being provided with a sleeve, and the holder engaging in the sleeve and being rigidly connected with the digger edge of the shovel bucket. The retainer is arranged in a holder opening extending parallel to the cutter edge of the tooth tip and in the longitudinal center line of the tooth, the retainer being made of two metal formed parts and a rubber element arranged between the two metal formed parts, the rubber element being stressed on compression. The retainer in the installed assembled condition on one side comes into contact on the surfaces of the tooth tip openings which face toward the cutter edge and on the other side comes into engagement on the surfaces of a recess arranged in the holder which face away from the cutter edge. The metal formed part which faces toward the cutter edge and which is open on the longitudinal sides and has stays on the face sides is disposed floating between the legs of the other U-shaped metal formed part. The latter being open on the longitudinal sides, facing the digging edge of the shovel bucket. The rubber element which connects the two metal formed parts is protected against a stress exceeding its fatigue strength in that the width of the gap between the face surface of the leg of that metal formed part which faces the digging edge of the shovel bucket and the inner wall of the holder or sleeve opening is smaller than the allowable compression of the spring system or the ride clearance which is permitted for maintaining the endurance or fatigue strength of the rubber element. The metal formed part which faces the cutter edge is provided on its outer surface with cams which serve for securing the retainer against falling out during stressing of the tooth tip.

7 Claims, 2 Drawing Figures

RETAINER FOR RELEASABLY SECURING A TOOTH TIP OF A DIGGER TOOTH

Figure 1:
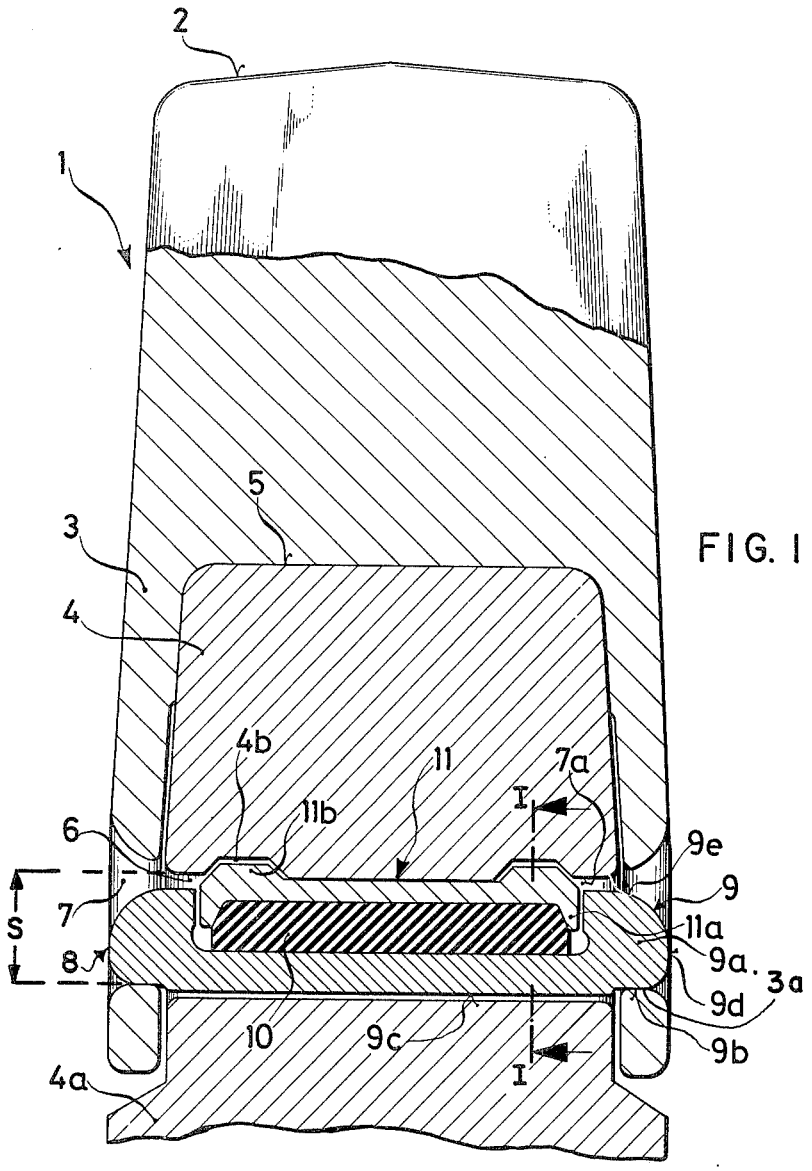

The invention relates to a retainer for the releaseable securing of a tooth tip of a digger tooth on a holder, the tooth tip being provided with a sleeve, and the holder engaging in the sleeve and being rigidly connected with the digger edge of the shovel bucket, the retainer being arranged in a holder opening extending parallel to the cutter edge of the tooth tip and in the longitudinal center line of the tooth, the retainer being made of two metal formed parts and a rubber element arranged between the two metal formed parts, the rubber element being stressed on compression. The retainer in the installed assembled condition on one side comes into contact or engagement on the surfaces of the tooth tip openings which surfaces face or point toward the cutter edge and on the other side comes into engagement on the surfaces of a recess arranged in the holder, which latter surfaces face or point away from the cutter edge.

With a known tooth holder, with which the holder is provided with a sleeve in which the tooth tip grips or engages therein, the securing of the tooth tip is brought about by means of a main wedge which is provided with a sack or socket hollow space and an auxiliary wedge provided with cams or projections, on which an unvulcanized rubber block is adhered. With such an arrangement only a very narrow rubber element can be used, since from the entire width of the retainer, the long or longitudinal sides of the main wedge and two expansion gaps, which must be provided between the elastic intermediate layer and the inner surfaces of the main wedge, are wasted or lost. The two expansion gaps are necessary since the elastic intermediate layer in the compressed condition occupies a considerably larger width than in the unloaded condition. From the construction of the known arrangement a result is that the elastic intermediate layer cannot be formed optimumly, so that only small forces are available for securing the retainer. Moreover it occurs that the elastic intermediate layer during the driving-in and driving-out of the retaining element is only compressed on one side and consequently only a part of the anyhow only low elasticity of the rubber element can be used, the low elasticity being by means of the small cross-sectional surface. In case the operator or service personnel during assembly of the retainer does not take care and pay attention, the retainer element can be installed twisted or turned by 180° which has the consequence that the retainer does not function. In the manner that the retainer is made of two separate parts, the handling or manipulation is made more difficult since one part can fall down and get lost.

It is a task and object of the present invention to construct a holder for a digger tooth such that the rubber element which serves as a spring on the one hand is loaded during the driving-in or driving-out of the connection element or retainer up to the elastic limit, and on the other hand during dynamic continuous or fatigue loading of the tooth tip during the work it retains endurance without symptoms of fatigue. During the driving-out of the retainer connection element the rubber element should be uniformly stressed over its entire length in order to achieve an optimum spring or resilient action. An inexpert installation or assembly of the retainer should be positively avoided.

It is another object of the present invention to aid in the solution of the first-mentioned objects in the manner that: the metal formed part (11) which faces or points toward the cutter edge (2) and which is open on the longitudinal sides and is provided with stays (11*a*) on the face sides is received floating between the legs (9*a*) of the other U-shaped metal formed part (9), the latter being open on the longitudinal sides, facing the digger edge of the shovel bucket; the rubber element (10) which connects the two metal formed parts (9, 11) is protected against a stress exceeding its fatigue strength or endurance limit in the manner that the width of the gap between the face surface (9*e*) of the leg (9*a*) of that metal formed part (9) which faces the digger edge of the shovel bucket and the inner wall (7*a*) of the holder opening or sleeve opening (7) is smaller than the allowable movement or compression of the spring system or the ride clearance which is permitted for maintaining the endurance or fatigue strength of the rubber element (10); and the metal formed part (11) which faces the cutter edge (2) is provided on its outer surface with cams (11*b*) which serve for securing the retainer against falling out during stressing of the tooth tip (1).

The advantage of the arrangement in accordance with the present invention resides in that the rubber element which is essential for the secure retaining of the tooth tip has the most advantageous dimensions with given dimensions of the tooth tip and of the sleeve, and the retainer which is made of one piece can be properly installed unturned or not inverted.

In accordance with another feature of the invention the metal formed part (9) which points to the digger edge is provided on both its ends with recesses (9*b*).

Still in accordance with another feature of the invention the height or level of the cams (11*b*) of the metal formed part (11) which faces the cutter edge (2) and the level or depth of the recesses (9*b*) of that metal formed part (9) which faces the digger edge of the shovel bucket are dimensioned such that during driving-out of the retainer, the rubber element (10) is compressed substantially up to its elastic limit.

Yet still in accordance with the invention the retainer, which comprises the U-shaped metal formed part (9), the rubber element (10) and the metal formed part (11) which faces the cutter edge (2), has a wedge-shaped cross-section corresponding to the sleeve opening (7) and holder opening.

Figure 2:
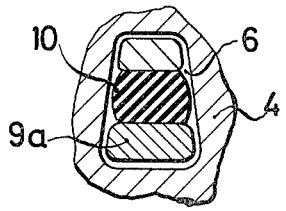

With the above and other objects and advantages in view, the present invention will become more clearly understood in connection with the following detailed description of a preferred embodiment, when considered with the accompanying drawings, of which:

FIG. 1 is a longitudinal cross-sectional view through the retainer connecting a tooth tip to the holder on a shovel bucket, broken away in parts; and FIG. 2 is a section taken along the lines I—I of FIG. 1.

Referring now to the drawings, the tooth tip 1 of a digger tooth is formed with a cutter edge 2 and a sleeve 3 thereof, and is slided or pushed over the holder 4. During the performance of excavation work the forces which act in the longitudinal direction of the tooth are received by the front surface 5 of the holder 4. In its forward third, the holder 4 is provided with a holder opening 6 which extends in the longitudinal center line of the tooth parallel to the cutter edge 2, corresponding to an opening 7 formed in the sleeve 3, so that a connection element or retainer 8 has room to be inserted therein for holding the tooth tip 1 to the holder 4.

The connection element 8 is made of a U-shaped metal moulded or formed part 9, a rubber element 10 and a metal formed or moulded part 11. The U-shaped metal formed part 9 is provided on its ends with reinforced or strong shoulders or legs 9*a*, whereas it is open on its long or longitudinal sides. The U-shaped metal formed part 9 and the metal formed part 11 are firmly or rigidly vulcanized onto the rubber element 10 so that the connection or retainer element 8 forms a connected or integrated unit.

The U-shaped metal formed part 9 at both ends thereof is provided with recesses 9*b* on its outer surface or side, which side points toward the base 4*a* of the holder 4, so that a shoulder 9*c* is present therebetween.

The metal formed part 11 is provided with stays or projections 11*a* on its face (end) sides, the rubber element 10 being received and connected to the part 11 between the stays or projections 11*a*. The free ends of the stays 11*a* are spaced from the inner longitudinal side of the formed part 9 by a distance greater than the effective gap between the inner wall 7*a* of the holder 4 and the adjacent and facing face surface 9*e* of the part 9. On its outer side or surface which points toward the cutter edge 2, the metal formed part 11 is formed with cams 11*b*, which cams are received in corresponding recesses 4*b* of the holder 4. The effective gap defined above and indicated by the end of the lead line 6 is dimensioned such that abutment of the surfaces 7*a* and 9*e* which may occur during operational excavation work load and stresses, only compresses the rubber element 10 less than its elastic limit.

The spacing S between the surface 7*a* of the holder opening 6 and the surface 3*a* of the sleeve opening 7 (which surface 3*a* points toward the cutter edge 2) is smaller than the distance between the free ends of the cams 11*b* and of the shoulder 9*c* in the non-compressed condition of the retainer by an amount substantially equal to but no greater than the permissible compression of the elastic element 10 constituting its elastic limit. The free ends of the stays 11*a* are spaced apart from the inner surface of the part 9 by a distance greater and not less than the difference of the spacing S from said distance between the free ends of the cams 11*b* and of the shoulder 9*c*.

So that the retainer 8 which comprises the two metal formed parts 9 and 11 and the rubber element 10 cannot be inserted inverted or turned around, the cross-section of the retainer is formed wedge-shaped corresponding to the sleeve openings. The cross-section of the holder opening 6 is also correspondingly wedge-shaped (as illustrated in FIG. 2).

The operation during driving-in of the retainer connection element 8 made of the two metal formed parts 9 and 11 and the rubber element 10 is as follows:

When the operator strikes against one of the face surfaces 9*d* of the U-shaped metal formed part 9 with a heavy hammer, then as a result, the metal formed part 11 is carried along by means of the stay 11*a* via the shoulder 9*a* of the metal formed part 9 which then abuts the closely adjacent parallel (yet perpendicular to the longitudinal axis of the retainer) end face of the stay 11*a* of the metal formed part 11, whereby an increasing compression or squeezing of the rubber element 10 is caused on the one side by the cam 11*b* of the metal formed part 11, and on the other side, by means of the shoulder 9*c* increasing as the end of the retainer extends through the sleeve (tooth tip) opening 7 and then through the holder opening 6. Finally both cams 11*b* of the retainer snap into the recesses 4*b* in the fully locked position of FIG. 1.

Subsequently when the connection element 8 is further driven out, a stronger compression of the rubber element 10 occurs than that which occurs by the loading of the excavator work.

While I have disclosed one embodiment of the invention it is to be understood that this embodiment is given by example only and not in a limiting sense.

I claim:

1. A retainer for the releaseable securing of a tooth tip of a digger tooth on a holder, the tooth tip having a sleeve, and the holder engaging in the sleeve and being rigidly connected with the digging edge of a shovel bucket, holder being formed with a holder opening extending parallel to the cutter edge of the tooth tip and in the longitudinal center line of the tooth, the tooth tip having tooth surfaces defining tooth tip openings substantially aligned with said holder opening, said tooth surfaces including first surfaces facing toward said cutter edge, said holder being formed with recess surfaces defining a recess in the holder, said recess surfaces facing away from the cutter edge, said retainer being inserted in said tooth tip and holder openings and comprising two metal formed parts and a rubber element arranged between said two metal formed parts, said rubber element being stressed on compression, said retainer in the inserted position on one side contacting said first surfaces of the tooth tip, and on the other side adapted to be urged toward contact with said recess surfaces of said recess in the holder, comprising in said openings the retainer including a first metal formed part facing toward the cutter edge, a second metal formed part, and a rubber element connecting and secured between said first and second metal formed parts, said second metal formed part is U-shaped defining legs and being open on elongated sides and facing the digging edge of the shovel bucket, said first metal formed part is formed open an elongated sides thereof and has projections on end face sides thereof, the rubber element being disposed therebetween, said first metal formed part being disposed floating between said legs of the U-shaped said second metal formed part, the tooth tip openings constituting sleeve openings in the sleeve of the tooth tip and the tooth surfaces further defining an inner wall of the sleeve openings, said legs of said second metal formed part have face surfaces facing said cutter edge, said face surfaces of said second metal formed part being spaced from said inner wall of said sleeve defining a gap therebetween, the size of said gap between the face surfaces of said legs of said second metal formed part and said inner wall at the sleeve openings is smaller than the permissible amount of additional compression of said rubber element beyond that existing in the inserted position of the retainer in the tooth tip and holder openings for maintaining the endurance of said rubber element, whereby said rubber element connecting said two metal formed parts is protected against stress exceeding its fatigue strength, said first metal formed part having an outer surface forming cam means for securing the retainer against falling out from the tooth tip and holder openings in the inserted position during stressing of the tooth tip.

2. The retainer as set forth in claim 1, wherein said second metal formed part on both ends thereof on an outer longitudinal side thereof is formed with recesses, respectively, abutting said first surfaces of the tooth tip in the sleeve openings, respectively.

3. The retainer as set forth in claim 2, wherein said cam means of said first metal formed part projects and defines a distance from the remainder of said outer surface of said first metal formed part, said recesses of said second metal formed part have a depth relative to the remainder of the outer surface of said second metal formed part, said distance of said cam means and said depth of said recesses are dimensioned such that during the driving-out removal of the retainer from said openings in said sleeve and holder respectively, said rubber element is compressed up to its elastic limit.

4. The retainer as set forth in claim 1, wherein the tooth surfaces including the first surfaces and said inner wall defining the sleeve openings have a wedge shape in cross-section, said retainer comprising the U-shaped second metal formed part, said rubber element and said first metal formed part has a wedge-shaped cross-section corresponding to that of the sleeve openings.

5. The retainer as set forth in claim 4, wherein said wedge-shaped cross-section of said retainer is substantially complementary to a wedge-shaped cross-section of the holder opening.

6. The retainer as set forth in claim 1 wherein said rubber element is secured to said first metal formed part to and between said projections and along one of said elongated sides thereof, said projections of said first metal formed part have free ends disposed between said legs of said second metal formed part, said free ends point toward one of said elongated sides of said second metal formed part.

7. A tooth tip releaseably secured in combination with a retainer and a holder, comprising a tooth tip of a digger tooth having a sleeve and a cutter edge, a holder projecting from and including an integrally connected digging edge of a shovel bucket, said sleeve being mounted on said holder, said holder having an inner wall forming a transverse holder opening extending parallel to the cutter edge of said tooth tip and in the longitudinal center line thereof, said tooth tip having tooth surfaces defining tooth tip openings in said sleeve substantially aligned with said holder opening, said tooth surfaces including first surfaces facing toward said cutter edge, said inner wall of said holder including recess surfaces, the latter defining at least one recess in said holder in said holder opening, said inner wall including an inner wall portion adjacent said recess surfaces, said recess surfaces and said inner wall portion facing away from said cutter edge, a retainer being disposed in an inserted position in said tooth tip and holder openings, respectively, and comprising a first and a second metal formed parts, respectively, and a rubber element connecting and secured between said first and second metal formed parts, said rubber element being stressed on compression, said retainer in the inserted position on one side thereof against said second metal formed part contacting said first surfaces of said tooth tip openings, and on the other side thereof against said first metal formed part contacting said inner wall on a side of the latter facing away from said cutter edge, said first metal formed part facing toward said cutter edge, said second metal formed part is U-shaped defining legs and being open on an elongated side, said second metal part facing the digging edge of the shovel bucket, said first metal formed part having open elongated sides and having projections on end face sides thereof, the rubber element being disposed therebetween, said first metal formed part being spaced from said second metal formed part and disposed floating relative thereto between said legs of second metal formed part, said legs of said second metal formed part having face surfaces facing said cutter edge and being spaced opposite said inner wall portion defining a gap therebetween, the size of said gap between the face surfaces of said legs of said second metal formed part and said inner wall portion is smaller than the permissible amount of additional compression of said rubber element beyond that existing in the inserted position of the retainer in the tooth tip and holder openings for maintaining the endurance of said rubber element, whereby said rubber element connecting said two metal formed parts is protected against stress exceeding its fatigue strength, said first metal formed part having an outer surface facing toward said cutter edge forming cam means thereon for securing the retainer against falling out from said tooth tip and holder openings during stressing of said tooth tip, said cam means being disposed in said at least one recess in said holder opening.

* * * * *